US005887767A

United States Patent [19]

Riley et al.

[11] Patent Number: 5,887,767

[45] Date of Patent: Mar. 30, 1999

[54] HOLDER FOR SPRAY TUBE

[76] Inventors: Mary T. Riley; Michael J. Riley, both of 9102 Laudry Blvd., Spring, Tex. 77379

[21] Appl. No.: 868,789

[22] Filed: Jun. 4, 1997

[51] Int. Cl.[6] ..... B65D 5/72

[52] U.S. Cl. ..... 222/538; 222/543

[58] Field of Search ..... 222/538, 543

[56] References Cited

U.S. PATENT DOCUMENTS

| | | | |
|---|---|---|---|
| D. 324,824 | 3/1992 | Hansen | D9/436 |
| 3,199,751 | 8/1965 | Jovanovich | 222/543 |
| 3,332,562 | 7/1967 | Pugh, Sr. | 215/100 |
| 3,445,033 | 5/1969 | Sweet et al. . | |
| 4,121,835 | 10/1978 | Garabedian | 239/33 X |
| 4,819,838 | 4/1989 | Hart, Jr. | 222/538 |
| 4,823,455 | 4/1989 | Diener | 222/538 X |
| 4,858,792 | 8/1989 | deLaforcade | 222/533 |
| 5,018,635 | 5/1991 | Whittaker . | |
| 5,044,512 | 9/1991 | Giancaspro et al. . | |
| 5,048,709 | 9/1991 | Alverson . | |
| 5,058,783 | 10/1991 | Antonelli | 222/538 |
| 5,297,704 | 3/1994 | Stollmeyer | 222/543 X |
| 5,328,069 | 7/1994 | Cohanfard | 224/148 |
| 5,529,226 | 6/1996 | Alberth, Jr. | 222/543 X |
| 5,544,783 | 8/1996 | Conigliaro | 222/538 X |

FOREIGN PATENT DOCUMENTS

| | | | |
|---|---|---|---|
| 2381683 | 9/1978 | France | 222/538 |
| 3937278 | 5/1991 | Germany | 222/538 |

*Primary Examiner*—Kevin P. Shaver
*Attorney, Agent, or Firm*—Guy McClung

[57] ABSTRACT

A tube holder has been invented for holding a spray tube for use with a nozzle of a spray can, the tube holder, in one aspect, having a ring stretchable or non-stretchable for encircling part of the spray can (e.g. body, nozzle, or nozzle projection) for mounting the tube holder to the spray can, an interconnection member having a first end and a second end, the first end connected to or formed integrally with the ring, and a holding member connected to or formed integrally with the second end of the interconnection member. In one embodiment the holding member is a ring (stretchable or non-stretchable) and in another embodiment the holding member is a body with at least one slit opening therethrough, the spray tube insertable through and removably holdable in the at least one slit opening. The present invention discloses a spray can with any such tube holder and with a hollow spray tube.

5 Claims, 4 Drawing Sheets

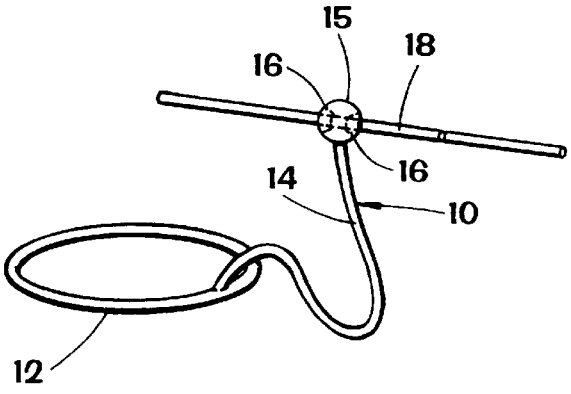
FIG.1A
FIG.1B
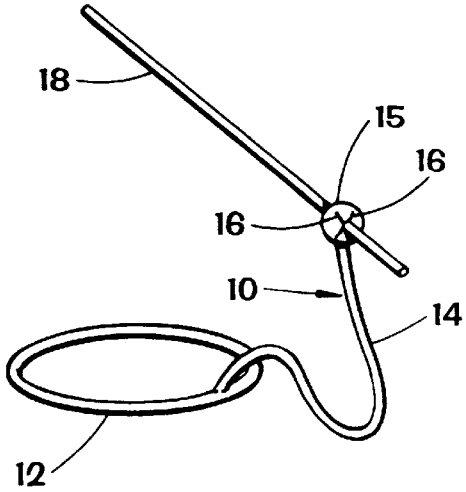
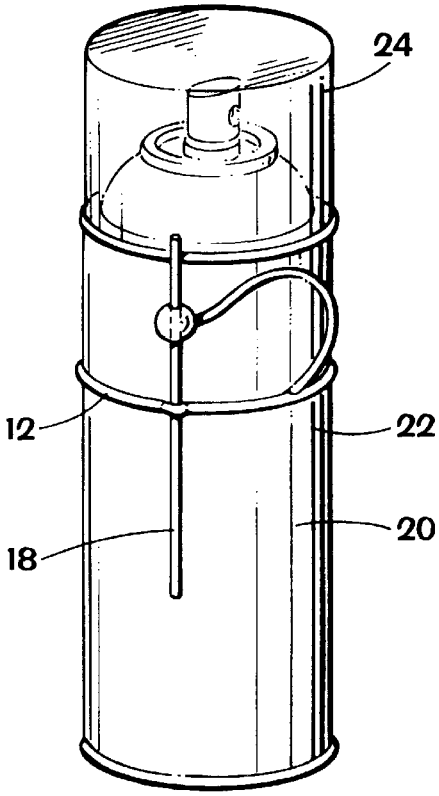
FIG.1C
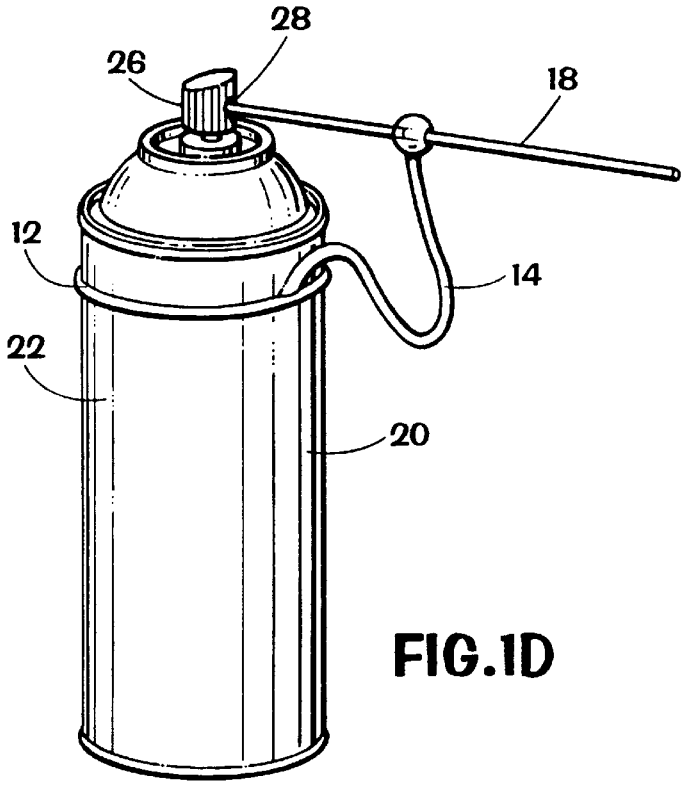
FIG.1D

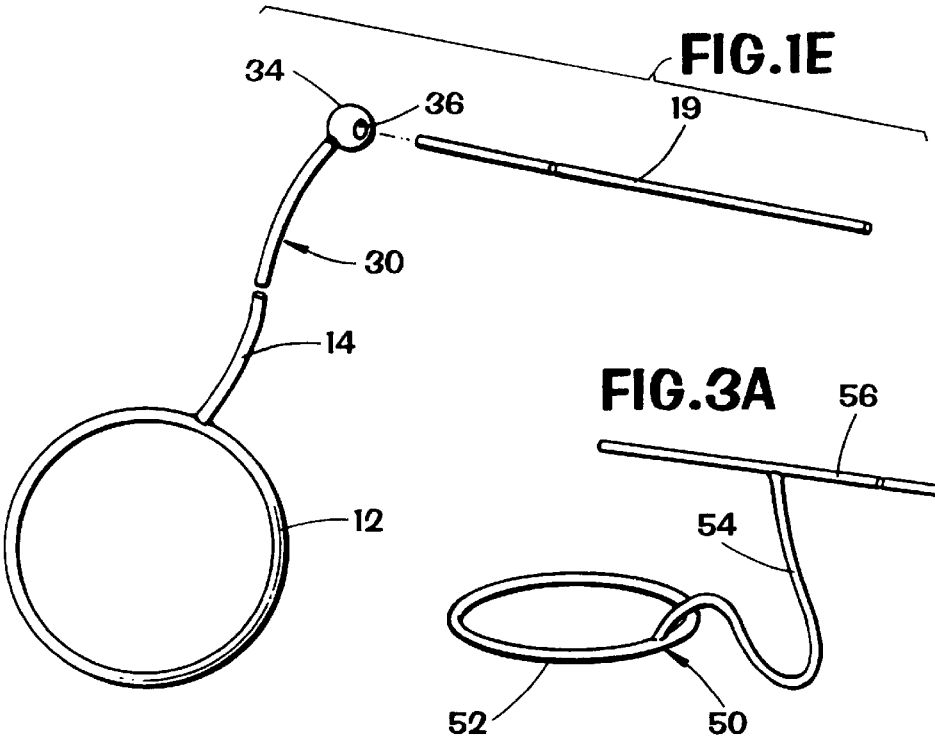
FIG.1E
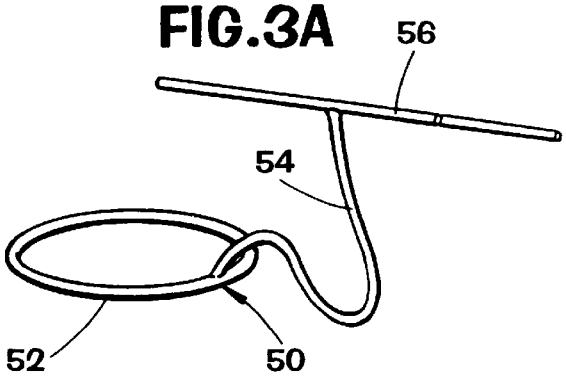
FIG.3A
FIG.2C
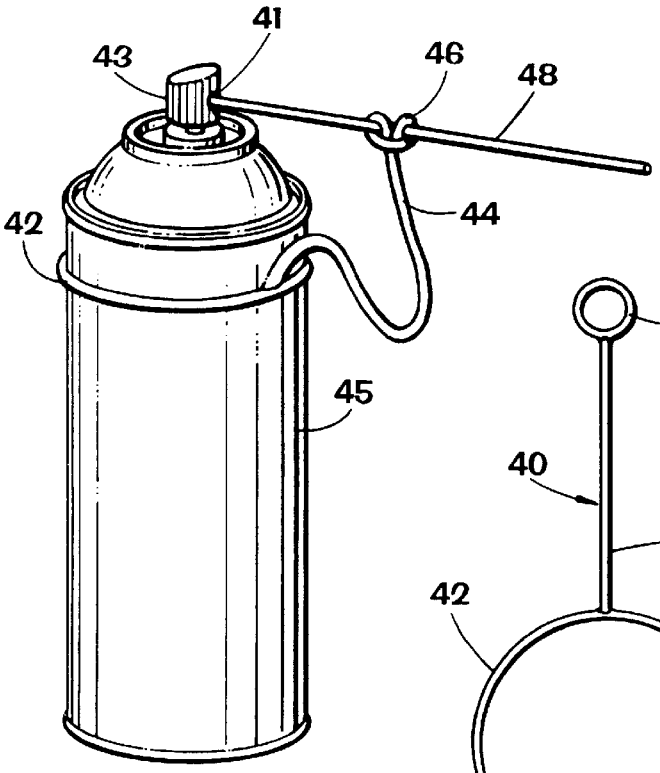
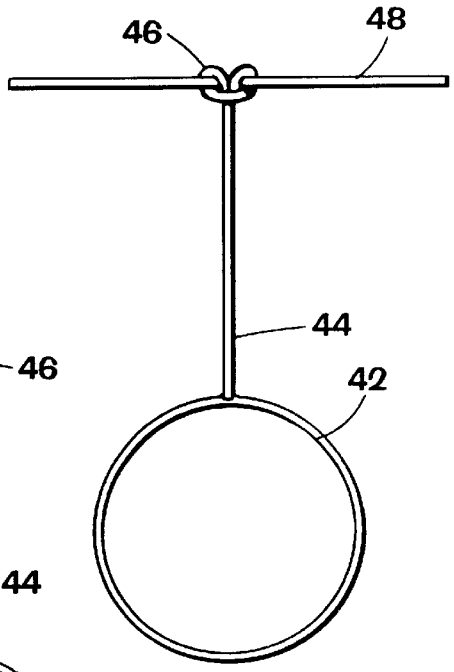
FIG.2B
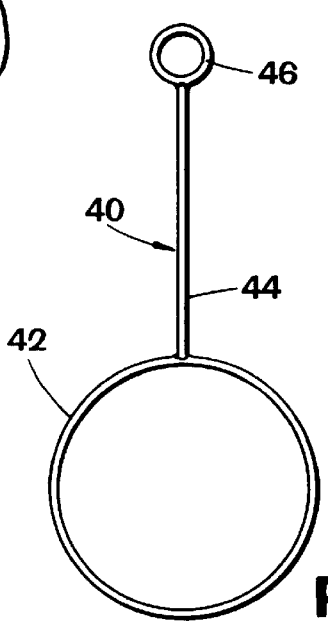
FIG.2A

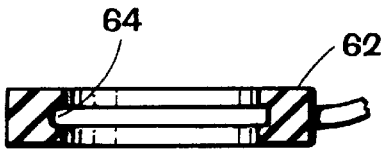
FIG.3D
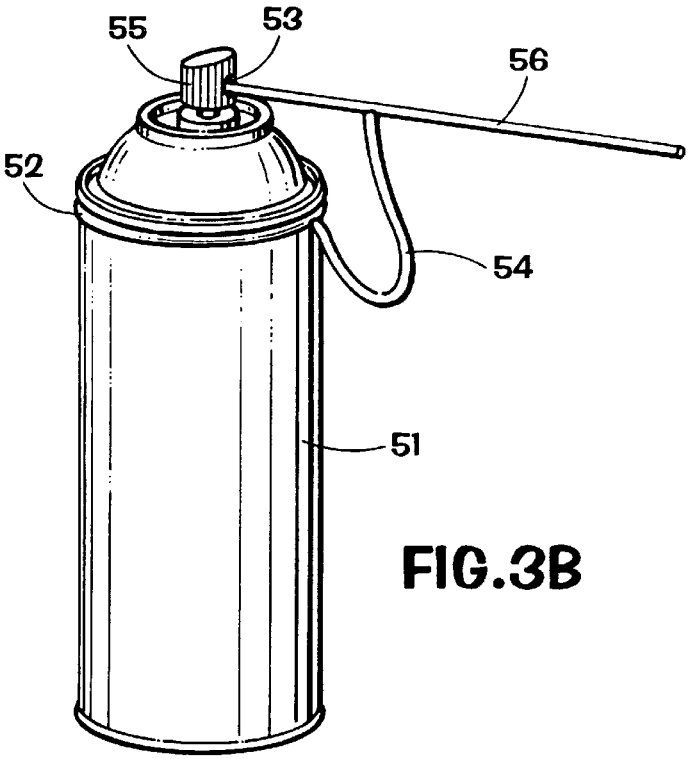
FIG.3B
FIG.4A
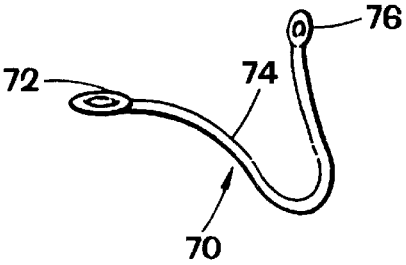
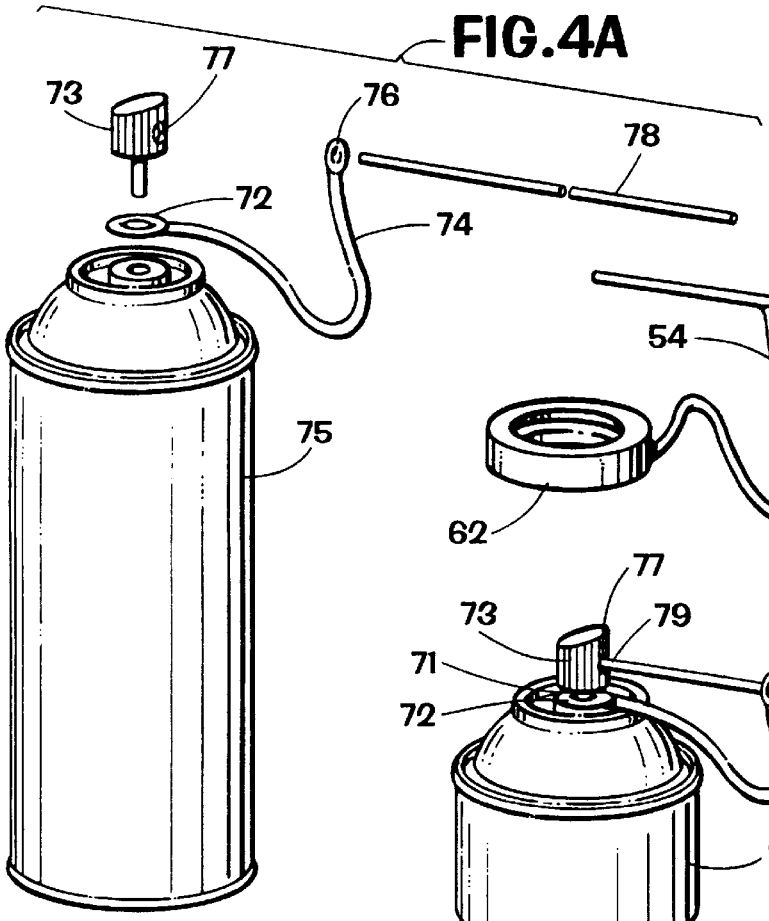
FIG.4A
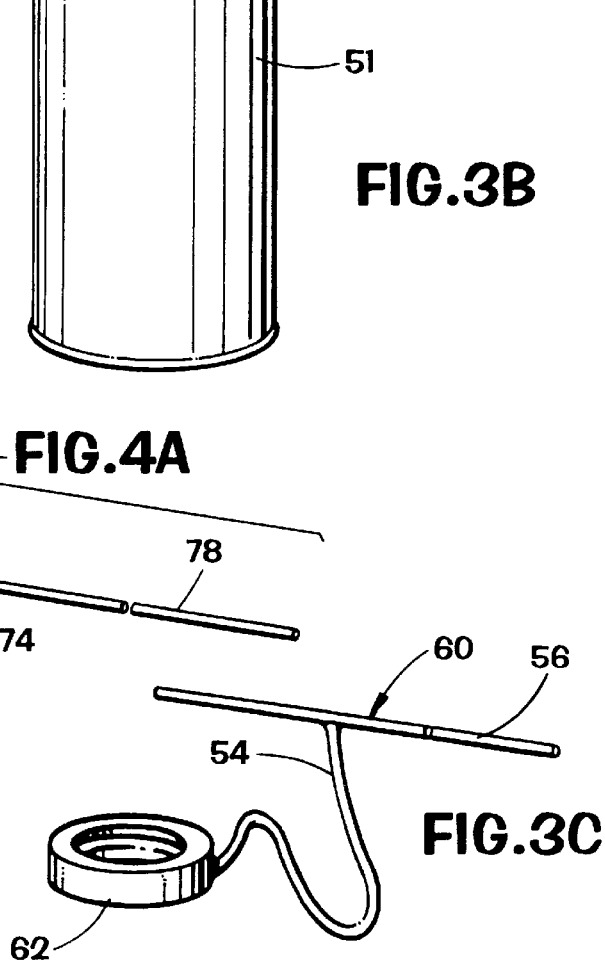
FIG.3C
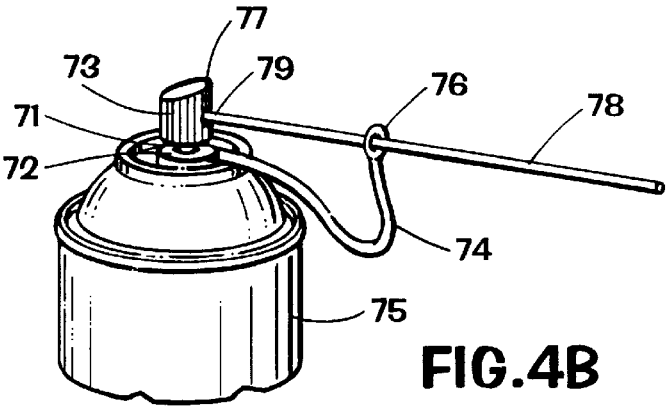
FIG.4B

HOLDER FOR SPRAY TUBE

BACKGROUND OF THE INVENTION

1. Field of the Invention

This invention is directed to spray or manual pump action containers with a nozzle into which a spray tube extender or spout is insertable; to a holder for such a spray tube; and to beverage containers with a drinking straw.

2. Description of Related Art

A wide variety of prior art spray containers, manual pump action containers, and aerosol-type spray cans have nozzles through which the container's contents is sprayed. With many of these containers, a hollow tube is provided which is insertable into the nozzle. Such tubes are used to focus a spray or to facilitate accurate direction of the spray to a specific part, area, or mechanism.

One common method of attaching a spray tube to a container is simply to use a piece of adhesive tape. Once the spray tube is released from the tape it is no longer connected to the container and is easily lost. For a person using a variety of containers with different contents and different size nozzles, it is important to have and use the correct spray tube for each container.

U.S. Pat. No. 5,058,783 discloses a spray container having a spray nozzle unit for outward discharge of fluid from the spray container that includes an elongated spray tube with a size and shape adapted for mounting onto the spray nozzle unit for guiding a spray of fluid discharged from the spray container and a spray tube support construction for use with the container that retains the spray tube adjacent the container. The support construction includes a support body and a holding element for holding the spray tube. A securing element affixes the support body to the spray container and a connected element affixes the holding element and the spray tube to the support body.

U.S. Pat. No. 4,823,445 discloses a clip for holding a spray tube on a spray can and a clip device that provides releasable retention of an accessory object to a primary object. The storage clip has a shaped clasp member having a jaw portion for secure engagement of a mounting strap, a body portion adjacent the jaw portion, a shoulder portion adjacent the body portion, and terminates in a tab portion adjacent the shoulder portion. The jaw, body, and shoulder portions are each configured to form an obtuse angle relative to its adjacent portion, and in the direction of said mounting strap, defining a void or cavity between the clasp member and the mounting strap. The terminating tab portion preferably forms an angle relative to the adjacent shoulder portion and away from the mounting strap, providing a manually engageable surface for lifting the clasp member away from the mounting strap.

U.S. Pat. No. 4,819,838 discloses a combined spray tube and support assembly for use with a spray container such as an aerosol can. The assembly has an elongated spray tube adapted for removable seating within a discharge port of a spray nozzle unit on the spray container. When separated from the spray nozzle unit, the spray tube is removably retained by a support member on the spray container or on a cap for the spray container. In one form, the support member has a vertically open support ring on the cap which cooperates with short outwardly projecting tabs near one end of the spray tube to support the spray tube alongside the spray container, with the tabs facilitating manipulation to seat the spray tube within the nozzle discharge port.

U.S. Pat. No. 5,544,783 discloses a clip-on device for removably holding a tube on an aerosol container, the device having a friction fit, flexible, circular clip-on portion to be attached to a side wall of said aerosol container, the clip-on portion extending substantially but not completely around the sidewall portion as a C-shaped clip, so the clip-on portion can snugly engage the side wall; and two integral brackets, removably receiving by friction fit a tube or straw, each bracket formed by a pair of curved legs unitarily formed in one piece with the clip-on portion, the curved legs spaced on the clip portion and having a bridging segment of the clip portion between them.

U.S. Design Pat. No. 324,824 discloses a combined vented closure for a container and a capped straw with a removable cap releasably held on a spout by an extended member with a ring that encircles the spout.

U.S. Pat. No. 5,044,512 discloses a sport bottle having a container for a liquid and a cover which seals to the container and which includes an aperture through which a straw extends outwardly from the cover to allow the user to drink from the container. A flexible handle element is secured to the cover and is disposed over the straw to allow the user to hold both the container and the straw. The handle element includes a cap for the straw so that the straw may be covered or closed when the sports bottle is not being used for drinking purposes. The cap prevents the liquid from sloshing out of the bottle and also prevents dirt, or the like, from entering through the straw and keeps the end of the straw or the portion of the straw which contacts the users lips, from accumulating dust, dirt, and the like.

U.S. Pat. No. 4,858,792 discloses a storage and dispensing unit with a container for product to be dispensed and a discharge conduit, a separate dispensing head with a part which is mountable on the container, and a pivotally mounted part including a push button and discharge applicator which has one end in communication with conduits formed internally of the push button so that when the push button is pivoted from a stored position to a dispensing position, the internal conduits of the push button are in communication with the discharge conduit of the container.

U.S. Pat. No. 5,328,069 discloses a beverage-container carrier and sipping assembly designed to replace the cap on a conventional bottle-type beverage container or to be directly attached to the circumferential edge of a sport bottle or an opened beverage can. The assembly has a dome shaped cover that has attached a carrying strap and a straw bore on its upper surface that accepts a drinking straw. The strap can be adjusted to an optimum length to hand carry the cover or to a length that allows the assembly to be placed around a person's neck or shoulders. In either case, the strap is attached to the container cover at points that correspond to the container shoulder or center-of-gravity. The container is comfortably balanced and supported when held by the strap. A vertically or horizontally oriented handle can be added to the cover to increase the assembly utility.

U.S. Pat. No. 5,048,709 discloses a straw-containing universal type cover assembly for a beverage container which includes a lid adapted to be snap fitted on an annular rim of the beverage container and is operative to simultaneously prevent spillage of and minimize decarbonation rates within the beverage once the container has been opened. The lid also includes a pull tab joined to the periphery thereof for both removing the lid from the beverage container and holding a straw in an upright position. The assembly further includes a multi-functional plug member attached to the straw by means of a flexible strap with a stem portion operative to be inserted into an opening in the lid in one orientation, with the lid opening being generally aligned with a sealed or previously sealed opening in the top of the beverage container. The plug member has an integral straw cap portion operative to fit in another orientation of the plug member over one end of the straw when the beverage container has been opened and the straw is not being used.

U.S. Pat. No. 3,445,033 discloses a container with a flexible drinking tube removably encircling the container within a flexible protective sheath.

U.S. Pat. No. 3,332,567 discloses a container with a groove or recess in which is removably positioned a drinking straw.

U.S. Pat. No. 5,018,635 discloses a fluid containment and access device for use with a beverage container having an upper, beaded rim and an opening for flow of the fluid contents from within the volume of the container includes a flexible lid, an integral straw and a vent with closure. The lid fits securely upon the top of the beverage container to form a fluid-tight seal. The straw has a first end extending above the lid and a second end that extends through the opening substantially to the bottom of the container. The vent closure is moveable between a first position to permit the flow of air into the container and a second position to prevent the flow of air into the beverage container.

There has long been a need for an effective spray tube holder that is simple in construction, easy to manipulate, and which, in certain aspects, can accommodate a variety of different tubes, different containers, and different container parts.

SUMMARY OF THE PRESENT INVENTION

The present invention, in certain aspects, discloses a spray tube holder that has a first flexible portion for removable positioning on part of a container (including, but not limited to, around a main container body, around a body, around a rim on a body, around a nozzle, or between a removable nozzle and the body) and a second flexible portion interconnected with the first flexible portion for connection to or removable positioning around the spray tube.

In another aspect the second flexible portion is deleted and an interconnecting member extending from the first flexible portion is attached or adhered to the spray tube. In another aspect a tube retainer is connected to the first flexible portion, the tube retainer having a retainer body with an opening or with one or more slits through which the spray tube movably extends.

In another aspect the first flexible portion is deleted and a substantially rigid ring is used which fits snugly around any part of the container.

Tubes, straws and containers according to this invention may be made of any suitable material, including, but not limited to, any suitable metal, plastic or fiberglass.

The present invention also discloses a container including any of the tube holders disclosed herein. A drinking straw may be held by or be part of any tube holder disclosed herein (instead of a spray tube) and used with a beverage container instead of a spray container.

The present invention, in certain embodiments discloses a tube holder for holding drinking straw for a beverage container or a spray tube for a nozzle of a spray can, the holder including a ring for encircling part of the can or container to mount the holder thereto, an interconnection member with a first and a second end, the first end connected to or formed integrally with the ring, a holding member with a body and connected to or formed integrally with the second end, the body with at least one slit opening therethrough, the straw or spray tube insertable through and removably holdable in the slit opening(s); such a holder wherein the ring is stretchable material for positioning around the can or container; such a holder wherein the at least one slit opening is a plurality of intersecting openings; and such a holder further including the spray tube or straw.

The present invention discloses, in certain embodiments, a holder for holding a straw for a beverage container or a hollow spray tube for use with a nozzle of a spray can, the holder having a first ring for encircling part of the spray can (or container) for mounting the holder thereto, an interconnection member having a first end and a second end, the first end connected to or formed integrally with the first ring, and a holding ring connected to or formed integrally with the second end of the interconnection member, the holding ring for holding the hollow spray tube or straw; such a holder wherein the first ring is made of stretchable material and is stretchable for releasable positioning around the spray can or container; such a holder wherein the holding ring is made of stretchable material for releasable holding of the spray tube or straw; such a holder wherein the nozzle has a hollow lower projection insertable into a top opening in the spray can or container and the holder's first ring is sized for receiving the hollow lower projection of the nozzle therethrough for releasable securement of the holder to the spray can or container; such a holder including the straw or the hollow spray tube; such a holder wherein the spray can or container has a top portion and the first ring is sized for emplacement on the top potion; such a holder wherein the first ring is made of resilient material for snap-on emplacement on the top portion and for snap-off removal therefrom; such a holder wherein the top portion of has an upper rim and the first ring has an inner groove for receiving and holding the upper rim; and such a holder wherein the first ring is made of resilient material for releasably holding the upper rim.

The present invention, in certain aspects, discloses a spray tube apparatus for use with a nozzle of a spray can, the nozzle having a fluid flow channel therethrough and an exit port from which contents of the spray can are propelled by manual pump action or by gas under pressure within the spray can, the spray tube apparatus having a hollow spray tube insertable into the exit port of the nozzle; a tube holder for holding the hollow spray tube, the tube holder having a first ring for encircling part of the can for mounting the tube holder to the can, an interconnection member having a first end and a second end, the first end connected to or formed integrally with the first ring, a holding ring for holding the tube and connected to or formed integrally with the second end of the interconnection member, the holding ring for holding the hollow spray tube, the first ring made of stretchable material and stretchable for releasable positioning around the spray can, and the holding ring made of stretchable material for releasable holding of the hollow spray tube; such a holder wherein the nozzle has a hollow lower projection insertable into a top opening in the spray can and the holder's first ring sized for receiving the hollow lower projection of the nozzle therethrough for releasable securement of the holder to the spray can; and such a holder wherein the spray can has a top portion with an upper rim and the first ring is made of resilient material for snap-on emplacement on the upper rim and for snap-off removal therefrom.

The present invention discloses, in certain embodiments a beverage container or spray can with a hollow body with contents therein (and, in the spray can, gas under pressure or a manual action pump for expelling the contents therefrom), and, with respect to the spray can, a nozzle connected to the spray can and having a fluid flow channel therethrough with an exit port for the passage of the contents out from the spray can; a hollow spray tube or a straw usable with the beverage container insertable into the exit port of the nozzle and a holder for holding the straw or spray tube, the holder having a ring for encircling part of the container or spray can for mounting the holder thereto; an interconnection member having a first end and a second end, the first end connected to or formed integrally with the ring, and a holding member holding the straw or hollow spray tube and connected to or formed integrally with the second end of the interconnection member; such a container or can wherein the ring is made of stretchable material to facilitate emplacement thereof, and wherein the holding member is a holding ring made of stretchable material for releasable holding of the straw or hollow spray tube; such a spray can wherein the nozzle has a hollow lower projection insertable into a top opening in the spray can and the holder's first ring sized for receiving the hollow lower projection of the nozzle therethrough for releasable securement of the tube holder to the spray can; and such a container or spray can wherein the holding member has at least one slit opening therethrough, the straw or hollow spray tube insertable through and removably holdable in the at least one slit opening.

It is, therefore, an object of at least certain preferred embodiments of the present invention to provide:

New, useful, unique, efficient, nonobvious devices for a holder for a tube used with a container and a container with such a tube;

Such a holder having a flexible portion for removable installation around a part of a container;

Such a holder for a spray tube for a manual pump action bottle or container or for an aerosol spray can;

Such a holder for a straw for a beverage container;

A holder with a second flexible portion for connection to the tube;

A holder with an interconnecting member connected to a first flexible portion for connection to the tube;

A holder with first and second flexible members, one for removable positioning around part of the container and one for removably holding the tube;

A holder with a first flexible member for positioning around part of a container and a tube holder with a body having one or more slits in which a tube is movably held; and A container with any such tube holder.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 1A is a perspective view of a tube holder according to the present invention. FIG. 1B is another perspective view of the tube holder of FIG. 1A. FIG. 1C shows a container according to the present invention with a tube holder as in FIG. 1A according to the present invention. FIG. 1D shows the container of FIG. 1C with a cap removed and the tube holder inserted into an exit port in a nozzle of the container. FIG. 1E is a perspective view that shows an alternative embodiment for a tube holder according to the present invention.

FIG. 2A shows a tube holder according to the present invention and FIG. 2B shows it connected to a tube. FIG. 2C shows the tube holder and the tube of FIG. 2B installed on a container according to the present invention.

FIG. 3A is a perspective view of a tube holder according to the present invention. FIG. 3B shows the tube holder and the tube of FIG. 3A installed on a container according to the present invention. FIG. 3C is a perspective view of an alternative embodiment for the tube holder of FIG. 3A and FIG. 3D is a crosssection view of the tube holder of FIG. 3C.

FIG. 4A is a perspective view of a tube holder according to the present invention. FIG. 4B shows the tube holder and the tube of FIG. 4A installed on a container (shown partially) according to the present invention. FIG. 4C is an exploded view of the container, tube, and tube holder of FIG. 4B.

DESCRIPTION OF EMBODIMENTS PREFERRED AT THE TIME OF FILING FOR THIS PATENT

Figures 5A, 5B, 6A, 6B, 6C:
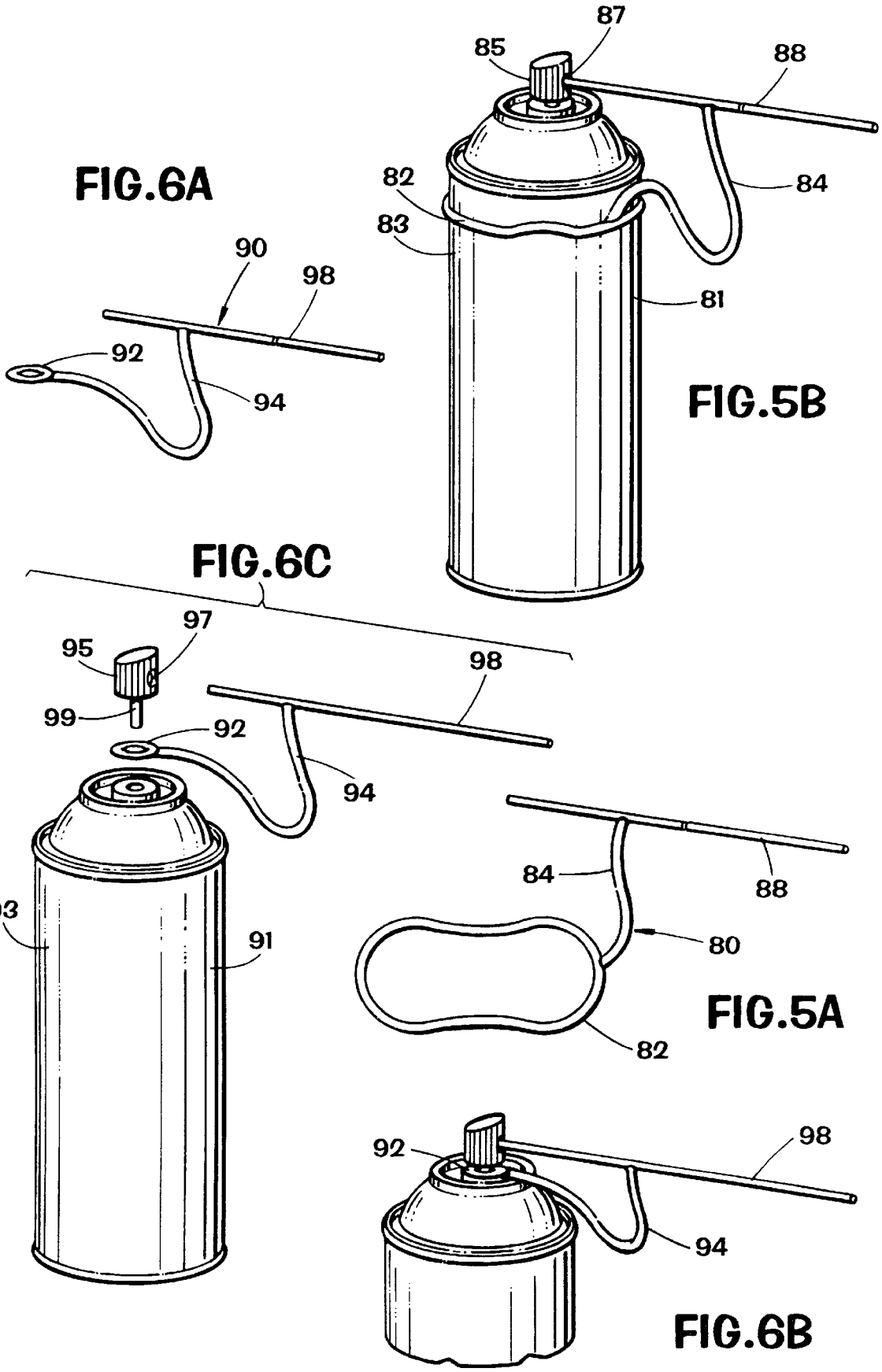
FIG. 5A is a perspective view of a tube holder according to the present invention.
FIG. 5B shows the tube holder and the tube of FIG. 5A installed on a container according to the present invention.
FIG. 6A is a perspective view of a tube holder according to the present invention.
FIG. 6B shows the tube holder and the tube of FIG. 6A installed on a container (shown partially) according to the present invention.
FIG. 6C is an exploded view of the container, tube, and tube holder of FIG. 6B.

FIGS. 1A and 1B show a tube holder 10 according to the present invention which has a flexible stretchable ring 12 (made, e.g. of rubber, plastic, or any suitable elastic material;

and in another aspect made of non-stretchable material); an interconnection member 14 connected to, adhered to, or formed integrally of the ring 12; and a holding member 15 with one or more slits 16 (two shown in this embodiment) extending therethrough. The interconnection member 14 is any desired length and may be made of stretchable or non-stretchable material. As shown in FIG. 1B, a hollow spray tube 18 has been pushed through the slits 16 in the holding member 14. The slits 16 are sized to permit passage therethrough of a tube while holding the tube so it will not inadvertently fall out. The slits are also sized so that the tube is removable from the holding member 14.

FIG. 1C shows the ring 12 stretched around a spray can 20 which has a body 22, a removable cap 24, a spray nozzle 26 with an exit port 28. As shown in FIG. 1C the tube 18 is held against the body 22 by the ring 12, and the ring 12 is movable on the body 22. As shown in FIG. 1D, the ring 12 remains around the body 12 when the tube 18 is inserted in the exit port 28 of the spray nozzle 26. Following use, the tube 18 may be removed from the holding member 14 and discarded and a new tube may be inserted therethrough, or the tube 18 may be retained for future use. The entire tube holder and tube may be removed for future use on the same or on another can.

FIG. 1E shows a tube holder 30 like the tube holder 10 (similar numerals indicate like parts), but with a holding member 34 that has a single hole 36 therethrough for releasably holding a tube 19 like the tube 18. In one aspect the holding member 34 is made of pliable material so it can accommodate several different diameter tubes.

FIG. 2A shows a tube holder 40 according to the present invention which has a first ring 42; an interconnection member 44 secured to or formed integrally of the first ring 42; and a second ring 46 secured to or formed integrally of the interconnection member 44. In one aspect the first ring 42, interconnection member 44, and/or the second ring 46 are all made of a flexible stretchable material. FIG. 2B shows the second ring 46 releasably entwined around a hollow spray tube 48. FIG. 2C shows the tube 48 inserted in an exit port 41 of a nozzle 43 of an aerosol container 45 and the first ring 42 releasably encircling the container 45.

FIG. 3A shows a tube holder 50 according to the present invention with a ring 52 made of rigid (i.e. relatively non-flexible) material; an interconnection member 54 (made, e.g. of either stretchable or non-stretchable material); and a hollow tube 56 formed integrally of or permanently secured to the interconnection member 54. The ring 52 fits on and around the top of a container 51 (see FIG. 3B). The tube 56 is inserted in an exit port 53 of a spray nozzle 55 of the container 51. The ring 52 may be any desired shape to correspond to the shape of a container (e.g. but not limited to, round, square, rectangular, hexagonal, pentagonal, etc.).

FIGS. 3C and 3D show a tube holder 60 like the tube holder 50 (similar parts indicated by like numerals), but with a ring 62 that has an inner groove 64 for receiving and holding a top rim of a can or container. The ring 62 may be made of resilient material so that it is emplaceable on a can's top rim and not removable (or removable only with difficulty) therefrom; or the ring 62 may be somewhat flexible so that it may be snapped on and snapped off of a can's top rim. The ring 62 may be any desired shape as viewed from above.

FIG. 4A shows a tube holder 70 according to the present invention with a first ring 72; an interconnection member 74; and a second ring 76. These pieces may be formed together integrally as a single unitary item or they may be adhered together or otherwise connected. As shown in FIGS. 4B and 4C, the first ring 72 is sized to receive a lower hollow projection 71 of a spray nozzle 73 of an aerosol container 75 while the second ring 76 is sized to releasably receive and hold a tube 78 which may have one end 79 inserted in an exit port 77 of the spray nozzle 73.

FIG. 5A shows a tube holder 80 according to the present invention with a stretchable ring 82; an interconnection member 84 connected to or formed integrally with the stretchable ring 82; and a hollow spray tube 88 permanently connected to an end of the interconnection member 84 (or, in another aspect, formed integrally therewith). FIG. 5B shows the tube holder 80 installed on a can 81 according to the present invention that has a body 83, and a spray nozzle 85 with an exit port 87 into which an end of the hollow tube 88 is inserted.

FIG. 6A shows a tube holder 90 according to the present invention with a stretchable ring 92; an interconnection member 94 connected to or formed integrally with the stretchable ring 92; and a hollow spray tube 98 permanently connected to an end of the interconnection member 94 (or, in another aspect, formed integrally therewith). FIG. 6B shows the tube holder 90 installed on a can 91 according to the present invention that has a body 93, and a spray nozzle 95 with an exit port 97 into which an end of the hollow tube 98 is inserted. The ring 92 is sized to fit around the projecting portion 99 and, in one aspect, to fit snugly yet removably therearound.

Other embodiments of the tube holders disclosed above use a partial rigid ring (instead of a closed stretchable ring) for releasable snap-on emplacement around a can or part thereof. Also, any tube—holding ring or structure may be sized and fashioned to fit around any part of a container, cap for a container, or nozzle m(so long as flow is not blocked). It is within the scope of this invention for any tube holder dislcosed herein to be used as a straw holder for a straw for a beverage container with a drinking straw substituted for the tube and a beverage container substituted for the spray can.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A tube holder for holding a hollow spray tube, the tube holder comprising a first ring, an interconnection member having a first end and a second end, the first end connected to or formed integrally with the first ring, and a holding ring connected to or formed integrally with the second end of the interconnection member, the holding ring made of stretchable material for releasably holding a hollow spray tube.

2. The tube holder of claim 1 wherein the first ring is made of stretchable material.

3. A spray can system comprising a spray can, a tube holder, and a spray tube, the spray can system further comprising the spray can comprising a hollow body with contents therein and gas under pressure for expelling the contents therefrom, and a nozzle connected to the spray can and having a fluid flow channel therethrough with an exit port for the passage of the contents out from the spray can, the spray tube comprising a hollow spray tube insertable into the exit port of the nozzle, and the tube holder comprising a tube holder for holding the spray tube, the tube holder further comprising a ring for encircling part of the spray can for mounting the tube holder to the spray can, an interconnection member having a first end and a second end, the first end connected to or formed integrally with the ring, a holding member holding the hollow spray tube and connected to or formed integrally with the second end of the interconnection member, and wherein the ring is made of stretchable material to facilitate emplacement thereof, and wherein the holding member is a holding ring made of stretchable material for releasable holding of the hollow spray tube.

4. The spray can system of claim 3 wherein the nozzle has a hollow lower projection insertable into a top opening in the spray can and the tube holder further comprising the first ring sized for receiving the hollow lower projection of the nozzle therethrough for releasable securement of the tube holder to the spray can.

5. The spray can system of claim 4 wherein the spray can has a top portion and wherein the top portion of the spray can has an upper rim and the ring has an inner groove for receiving and holding the upper rim.

* * * * *